US005441002A

United States Patent [19]

Satoma

[11] Patent Number: 5,441,002

[45] Date of Patent: Aug. 15, 1995

[54] FOUR ELEMENT HEMMER FOR A SEWING MACHINE

[75] Inventor: Shiro Satoma, Tokyo, Japan

[73] Assignee: Juki Corporation, Tokyo, Japan

[21] Appl. No.: 286,192

[22] Filed: Aug. 8, 1994

[30] Foreign Application Priority Data

Dec. 6, 1993 [JP] Japan ..... 5-065018 U

[51] Int. Cl.[6] ..... D05B 35/02

[52] U.S. Cl. ..... 112/143; 112/153

[58] Field of Search ..... 112/136, 141, 143, 147, 112/152, 153

[56] References Cited

U.S. PATENT DOCUMENTS

| | | | |
|---|---|---|---|
| 132,062 | 10/1872 | Darby | 112/143 |
| 855,304 | 5/1907 | Greist | 112/143 |
| 1,044,413 | 11/1912 | Nicholson | 112/141 |
| 1,082,351 | 12/1913 | McNelly | 112/153 |
| 1,681,949 | 8/1928 | Morvay | 112/141 |
| 2,278,042 | 3/1942 | Sailer | 112/143 |

FOREIGN PATENT DOCUMENTS 190,821 9/1992 China

*Primary Examiner*—Clifford Crowder
*Assistant Examiner*—Ismael Izaguirre
*Attorney, Agent, or Firm*—Finnegan, Henderson, Farabow, Garrett & Dunner

[57] ABSTRACT

A guide device for a sewing machine which is used for at least hemming of a bottom of a work, sewing a tape on the work and sewing a rolled hem tape on the work comprises four guide members. A first guide member has a regulating surface for regulating an edge of the tape supplied beneath the work, and is mounted on the bed of the sewing machine. A second guide member has two regulating surfaces which regulate the position of one edge of the work or one edge of the rolled hem tape and the position of the other edge of the rolled hem tape, respectively, and is fixedly mounted on the first guide member. A third guide member has a narrow space into which the work or one fold of the rolled hem tape is inserted, and is mounted on the first guide member. A fourth guide member has a pushing surface for pushing the other fold of the rolled hem tape against said second guide member, and is mounted on said third guide member.

5 Claims, 4 Drawing Sheets

FOUR ELEMENT HEMMER FOR A SEWING MACHINE

BACKGROUND OF THE INVENTION

This invention relates to guide devices for a sewing machine which are utilized for hemming the fabric, and more particularly to a guide device with which a bottom hem stitching for hemming the bottom of a T-shaped undershirt or the like, and an operation of sewing a rubber tape or a rolled hem tape on a work (hereinafter referred to as "a tape stitching", when applicable) are carried out.

Heretofore, in order to perform the aforementioned bottom hem stitching or tape stitching, it is necessary to attached a guide device (or jig) to the sewing machine which is provided only for the operation.

However, the above-described conventional guide devices are disadvantageous in the following points: That is, different guide devices must be employed for different sewing operations; in other words, the guide devices must be used separately according to the kinds of sewing operations. This is rather troublesome.

A conventional guide device for sewing a rolled hem tape, namely, a rolled hemming binder is intricate in construction, thus being expensive.

In view of the foregoing, an object of the invention is to provide a guide device for a sewing machine with which both the bottom hem stitching and the tape stitching can be performed and which can be manufactured at low cost.

SUMMARY OF THE INVENTION

The foregoing object of the invention has been achieved by the provision of a guide device for a sewing machine which are used for at least hemming of a bottom of a work, sewing a tape on the work and sewing a rolled hem tape on the work, the guide device comprising four guide members. A first guide member has a regulating surface for regulating an edge of the tape supplied beneath the work, and is mounted on the bed of the sewing machine. A second guide member has two regulating surfaces which regulate the position of one edge of the work or one edge of the rolled hem tape and the position of the other edge of the rolled hem tape, respectively, and is fixedly mounted on the first guide member. A third guide member has a narrow space into which the work or one fold of the rolled hem tape is inserted, and is mounted on the first guide member. A fourth guide member has a pushing surface for pushing the other fold of the rolled hem tape against said second guide member, and is mounted on said third guide member.

A bottom hem stitching using a two-needle type sewing machine equipped with the guide device according to the invention is performed as follows: First, the first guide member is moved in a horizontal direction orthogonal with the sewing direction until one regulating surface of the second guide member, against which the work which is folded being inserted into the narrow space in the third guide member is abutted, is in alignment with the position of the left needle in the sewing machine. The first guide member thus moved is fixedly mounted on the bed of the sewing machine. Under this condition, the third guide member is moved in the aforementioned horizontal direction until the distance in the horizontal direction between the one regulating surface of the second guide member and the narrow space of the third guide member becomes equal to the width of the work to be hemmed. The third guide member thus moved is fixedly mounted on the first guide member. Thereafter, the work is inserted into the narrow space so that it is folded with its edge abutted against the one regulating surface of the second guide member. As a result, the work with the bottom folded is fed through the guide device towards the needle plate of the sewing machine. Thus, the work, while being pressed with the work retainer, is sewn with the two needles.

In the case where it is required to sew a decorating tape on the bottom of a work which is to be hemmed, the above-described hemming operation is carried out with the decorating tape set below the first guide member in such a manner that its edge is abutted against the regulating surface of the first guide member.

In the case where it is required to sew a tape on the bottom of a work which is not to be hemmed, it is unnecessary to fold the bottom of the work. That is, in this case, the tape stitching is carried out with the edge of the work abutted against the other regulating surface of the second guide member.

In a tape stitching for sewing a rolled hem tape on the bottom of the work, similarly as in the above-described bottom hem stitching the position of the first guide member is adjusted in a horizontal direction orthogonal with the sewing direction until the one regulating surface of the second guide member, against which the work which is folded being inserted into the narrow space in the third guide member is abutted, is in alignment with the position of the left needle in the sewing machine, and the first guide member thus adjusted is fixedly mounted on the bed of the sewing machine. Thereafter, the third guide member is moved in the aforementioned horizontal direction so that both edges of the rolled hem tape inserted into the narrow space in the third guide member abut against one of the regulating surfaces of the second guide member. Under this condition, the rolled hem tape is folded being inserted into the narrow gap and extended along the second guide member, so that both edges of the rolled hem taped abut against the two regulating surfaces of the second guide member. Next, the fourth guide member is moved in the horizontal direction so that the other fold of the rolled hem tape is pushed against the second guide member. The fourth guide member thus moved is fixedly mounted on the third guide member. Under this condition, the sewing operation is carried out while, with the edge of the work kept abutted against the other regulating surface of the second guide member, the work and the rolled hem tape are fed in such a manner that they are partially joined with each other.

DETAILED DESCRIPTION OF THE PREFERRED EMBODIMENTS

A guide device for a sewing machine according to the present invention will be described with reference to the accompanying drawings.

Figure 1:
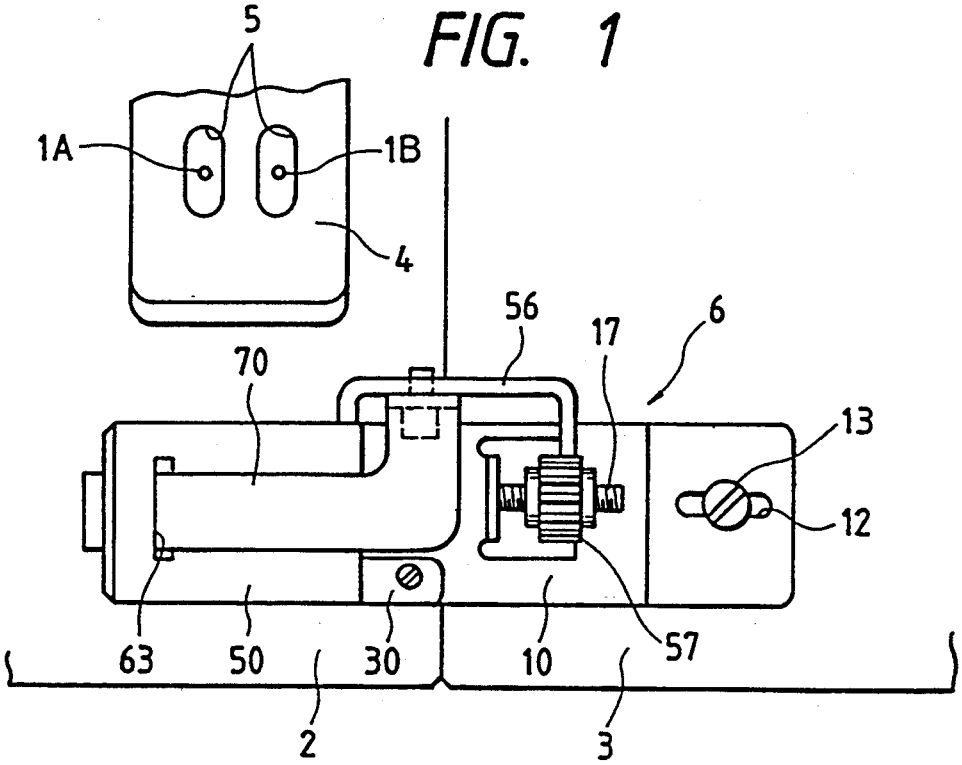
FIG. 1 is a plan view showing a part of a sewing machine equipped with a guide device according to the invention.

FIG. 1 shows essential components of a sewing machine equipped with the guide device according to the invention. The sewing machine is of the type that sewing is carried out with two needles 1A and 1B which are held spaced from each other. A bed 2 and an auxiliary bed 3, which are generally referred to as "a bed" in the above-described SUMMARY OF THE INVENTION, are arranged side by side. Feed teeth (not shown) are arranged along one edge of the bed 2, and a work retainer 4 is provided above the feed teeth in such a manner that it is movable to and from the feed teeth. The work retainer 4 has two through-holes 5 and 5 into which the aforementioned needles 1A and 1B are inserted.

The bed 2 and the auxiliary bed 3 are located upstream of the work retainer 4 in the work feeding direction. A guide device 6 according to the invention is provided over the bed 2 and 3.

Figure 2:
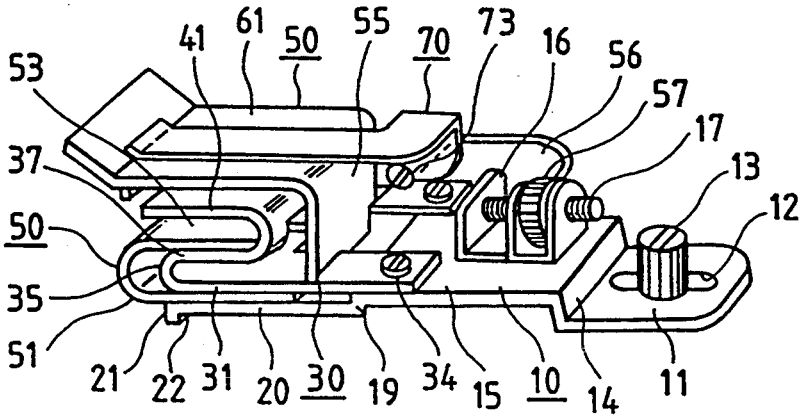
FIG. 2 is a perspective view of the guide device shown in FIG. 1.
Figure 3:
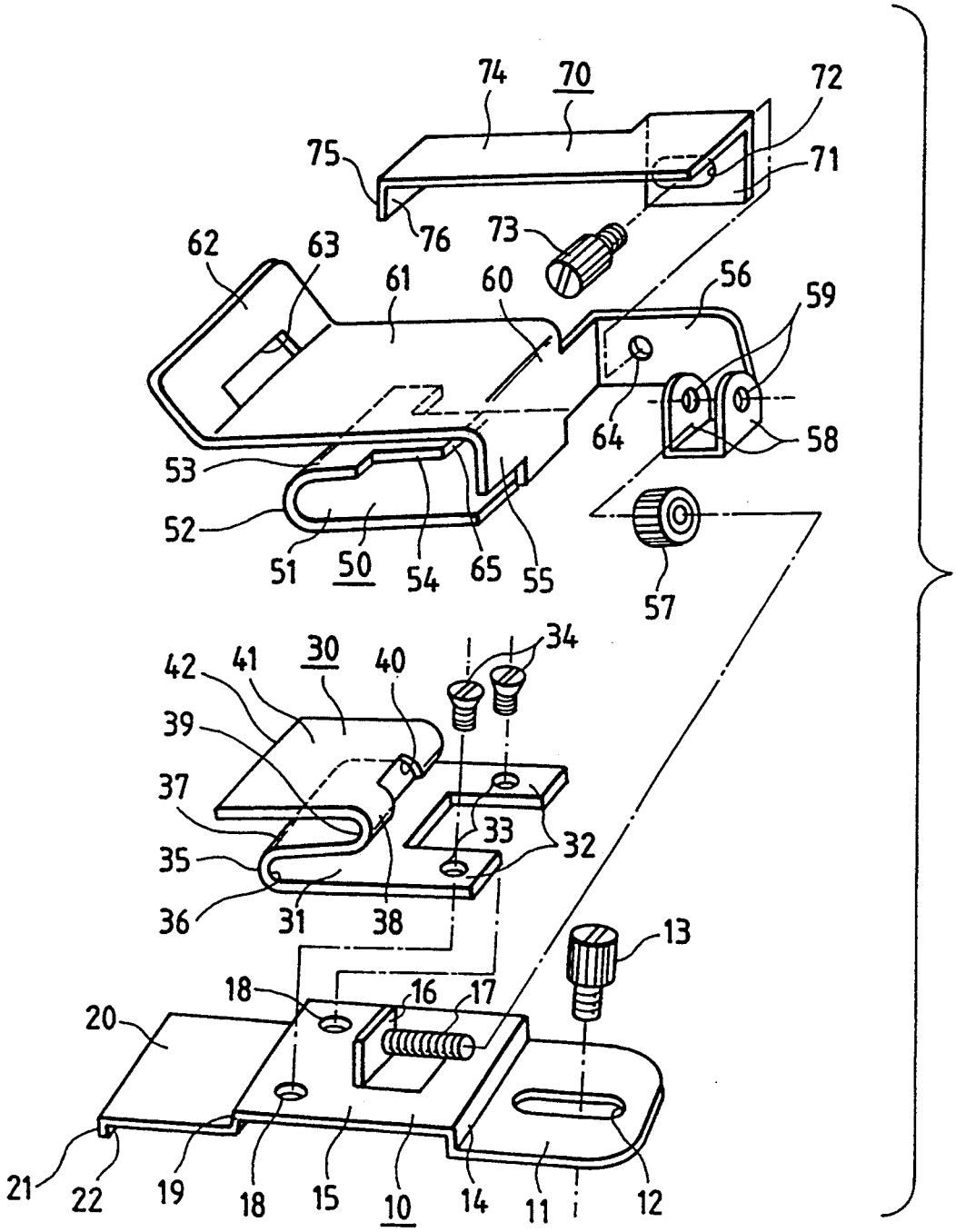
FIG. 3 is an exploded view of the guide device shown in FIG. 2.

The guide device 6, as shown in FIGS. 2 and 3, has a first guide member 10, a second guide member 30, a third guide member 50, and a fourth guide member 70.

The first guide member 10 is made of a plate which is extended in a horizontal direction which is orthogonal with the aforementioned sewing direction (hereinafter referred to as "an orthogonal horizontal direction", when applicable). The end portion of the first guide member 10 which is on the side of the auxiliary bed 3, is a first plate portion 11 which is mounted on the auxiliary bed 3. The first plate portion 11 has an elongated hole 12 which is extended in the orthogonal horizontal direction. A locking screw 13 is inserted into the elongated hole 12 and engaged with a threaded hole (not shown) formed in the auxiliary bed 3, so that the first guide member 10 is fixedly secured to the latter 3. In this operation, the position of the first guide member 10 can be adjusted in the orthogonal horizontal direction by shifting the position of the locking screw 13 in the elongated hole 12.

The first plate portion 11 merges through a vertical portion 14 extremely small in height with a second plate portion 15. A substantially L-shaped bracket 16 is raised from the second plate portion 15, and has a position adjusting screw 17 protruded therefrom. More specifically, the position adjusting screw 17 is extended in the orthogonal horizontal direction. As shown in FIG. 3, two threaded holes 8 and 8 are formed in the left end region of the second plate portion 15 which are spaced from each other in the sewing direction.

The left end of the second plate portion 15 merges with a third plate portion 20 through a vertical portion 19 which is smaller in height than the aforementioned vertical portion 14, in such a manner that the third plate portion 20 is lower than the second plate portion 15. More specifically, the height of the third plate portion 20 is so determined that a tape T1 to be sewed on a work C may be placed on the bed 2 below the third plate portion 20. The third plate portion 20 has a vertical portion 21 along the left edge. The inner surface of the vertical portion 21 is extended in the sewing direction, thus serving as a linear regulating surface 22 for positioning the edge of the tape T1.

The second guide member 30, which is fixedly mounted on the first guide member 10 by using the threaded holes 18, has a base plate (a first plate portion) 31. The base plate 31 has two arms 32 which are protruded from both ends of one edge of the base plate 31 in the same direction (to the right in FIG. 3). The arms 32 have small-diameter round holes 33, respectively, in such a manner that the distance between the round holes is equal to that between the threaded holes 18. Locking screws 34 are inserted into the round holes 33 and engaged with the threaded holes 18 of the first guide member 10 to fixedly mount the second guide member 30 on the first guide member 10. In this operation, the larger part of the base plate 31 is confronted with the third plate portion 20 of the first guide member 10 with a space between them.

A first curved portion 35 is extended from the end of the base plate 31 which comes substantially right above the vertical portion 21 of the first guide member 10. The inner surface of the first curved portion 35, namely, a first regulating surface 36 is curved in section and extended linearly to position the edge of the work C or the edge of a rolled hem tape T2.

A second plate portion 37 is extended from the upper end of the first curved portion 35 in such a manner that it is over the base plate 31 and substantially in parallel with the latter 31. More specifically, the second plate portion 37 is extended substantially to the middle of the third plate member 20 in the aforementioned orthogonal horizontal direction.

The end of the second plate portion 37 merges with a second curved portion 38 which is curved upwardly. The inner surface of the second curved portion 38, namely, a second regulating surface 39, is curved in section and extended linearly to position the edge of the work C or the edge of a rolled hem tape T2. The second curved portion 38 has an opening 40 at the middle in the longitudinal direction.

The upper end of the second curved portion 38 merges with a third plate portion 41 in such a manner that the latter 41 is extended over the second plate portion 37 and in parallel with the latter 37. More specifically, the third plate portion 41 is extended over the vertical portion 21 of the third plate portion 20 of the first guide member 10 in the orthogonal horizontal direction. The end 42 of the third plate portion 41 acts to fold the rolled hem tape T2.

The third guide member 50 is fixedly mounted on the first guide member 10 in such a manner that it is combined with the second guide member 30. The third guide member 50 includes a base plate (a first plate portion) 51 which is partially placed on the third plate portion 20 of the first guide member 10. The base plate 51 is adjusted in position by being slid on the third plate portion 20 of the first guide member in the orthogonal horizontal direction according to the width of the bottom of the work C which is to be hemmed. When the third guide member 50 is shifted maximumly to the left in FIG. 2, the larger part of the base plate 51 comes outside the third plate portion 20 of the first guide member 10.

The end of the base plate 51, which comes outside the third plate portion 20 of the first guide member 10, merges with a first curved portion 52 which is curved upwardly. The upper end of the first curve portion 52 merges with a second plate portion 53 which is extended over the base portion 51 and substantially in parallel with the latter 51 and is located between the second plate portion 37 and the third plate portion 41 of the second guide member 30. More specifically, the second plate member 53 is so extended as to cover about one-third ($\frac{1}{3}$) of the base plate 51 in the orthogonal horizontal direction. A tongue piece 54 is extended from the middle of the end of the second plate portion which is loosely inserted into the opening 40 of the second guide member 30.

A supporting portion 55 is extended from the end of the base plate 51 which end is opposite to the end from which the first curve portion 52 is extended, in such a manner that it is raised between the arms 32 and 32 of the second guide member 30. The part of the supporting portion 55 which is above the arms 32, is equal in width to the base plate 51.

An arm 56 is extended from the vertical edge of the supporting portion 55 which is on the side of the work retainer 4. More specifically, the arm 56 is somewhat extended towards the work retainer 4 from the vertical edge of the supporting portion 55 and is then bent at right angles in a horizontal plane to face the auxiliary base 3, and then it is bent at right angles again near the position adjusting screw 17 to approach the latter 17.

A position adjusting nut 57 is threadably engaged with the position adjusting screw 17. On the other hand, the above-described arm 56 has a pair of brackets 58 at the end which hold the position adjusting nut 57 between them. Those brackets 58 have through-holes 59, respectively, into which the position adjusting screw 17 is loosely inserted. With the position adjusting nut 57 set between the brackets 58, the position adjusting screw 17 is engaged with the position adjusting nut 57 while being loosely inserted into the brackets 58. When, under this condition, the position adjusting nut 57 is turned, the latter 57 is moved forwardly or reversely along the position adjusting screw to push one of the brackets 58. Thus, the third guide member 50 can be fixedly mounted on the first guide member 10 in such a manner that its position can be adjusted in the aforementioned orthogonal horizontal direction when required.

In the third guide member 50, the upper end of the supporting portion 55 merges through a second curved portion 60 with a third plate portion 61 which is extended over the third plate portion 41 of the second guide member 30 and in parallel with the third plate portion 41. More specifically, the third plate portion 61 is extended substantially to come right above the first curve portion 52 of the third guide member 50.

A tongue piece 62 is obliquely upwardly extended from the end of the third plate portion 61. The tongue piece 62 has an opening 63 in its base portion at the middle. The portion of the above-described arm 56 which is extended in the orthogonal horizontal direction, has a threaded hole 64 which is utilized for fixing the aforementioned four guide member 70.

In order to fold the work C or the rolled hem tape T2, a narrow space 65, which is a small gap, is provided between the end of the tongue piece 54 of the second plate portion 53 and the above-described supporting portion 55.

The fourth guide member 70, which is fixedly mounted on the third guide member 50, has a relatively small vertical portion 71 thereto. The vertical portion 71 has an elongated hole 72 which is extended in the orthogonal horizontal direction. A locking screw 73 is inserted into the elongated hole 72 and engaged with the threaded hole 64 of the third guide member 50, to fixedly mount the fourth guide member 70 on the third guide member 50. In this operation, the position of the fourth guide member 70 can be adjusted in the orthogonal horizontal direction by shifting the position of the locking screw 73 in the elongated hole 72.

The upper end of the vertical portion 71 merges with a horizontal plate portion 74 which is extended over the third guide member 50. The free end portion of the horizontal plate portion 74 is inserted into the opening 63 of the tongue piece 62 of the third guide member 50. The freed end portion of the horizontal plate portion 74 includes a pushing portion 74 which is extended downwardly. The inner surface of the pushing portion 74 is extended linearly in the sewing direction, thus serving as a pushing surface 76 to push the fold of the rolled hem tape T2 against the end 42 of the third plate portion 41 of the second guide member 30.

The guide device thus constructed functions as follows:

First, the functions of the guide device will be described with reference to the bottom hem stitching among the variety of sewing operations.

In order to perform the bottom hem stitching, the position of the first guide member is adjusted in the orthogonal horizontal direction until the first regulating surface 36 of the second guide member 30, against which the edge of the work C which is folded being inserted into the narrow space 65 in the third guide member 30 is abutted, is in alignment with the position of the left needle 1A of the sewing machine. Under this condition, the locking screw 13 is inserted into the elongated hole 12 of the first guide member and engaged with the auxiliary bed 3, to fixedly mount the first guide member 10 on the auxiliary bed 3.

Under this condition, the third guide member 50 is moved with respect to the first guide member 10 by turning the position adjusting nut 57 until the distance in the orthogonal horizontal direction between the first regulating surface 36 of the second guide member 30 and the narrow space 65 of the third guide member 50 becomes equal to the width of the work.

Figure 4:
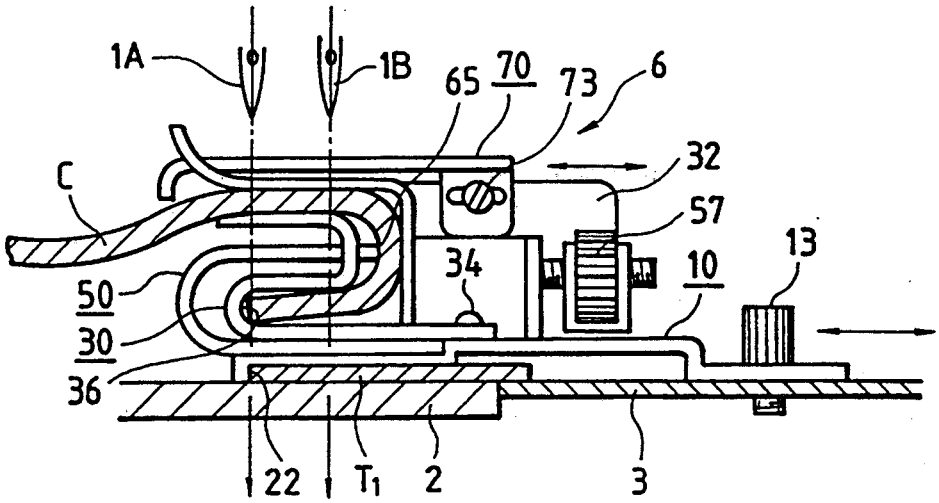
FIG. 4 is a front view, partially as a longitudinal sectional view, for a description of a bottom hem stitching with the guide device according to the invention.
Figure 6A:
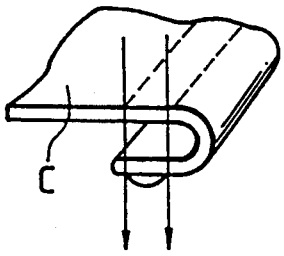
FIG. 6(A) is a perspective diagram for a description of a bottom hem stitching.

Thereafter, as shown in FIG. 4, the work C is inserted into the narrow space 65 so that it is folded and its edge is abutted against the first regulating surface 36 of the second guide member 30. As a result, the work C with the bottom folded is fed through the guide device towards the needle plate of the sewing machine. Under this condition, the work C, while being pressed with the work retainer 4, is sewn with the two needles 1A and 1B. That is, the bottom hem stitching is carried out as shown in FIG. 6(A).

In FIG. 4, a tape T1 is shown below the first guide member 10. Of course, the tape T1 is required for a tape stitching (described later), and it is not necessary for the bottom hem stitching. That is, the tape T1 is shown just for the sake of convenience in the description of the tape stitching which will be made later. In the case where the bottom hem stitching is of chain stitch, the guide device 6 can be removed from the sewing machine after the sewing has been accomplished.

Figure 6B:
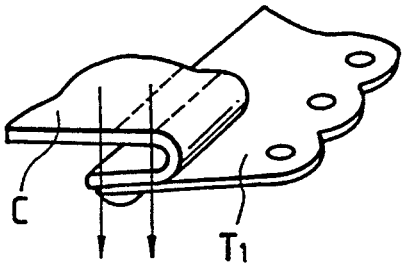
FIG. 6(B) is a perspective diagram for a description of a tape stitching.

In the case where it is required to sew the decorating tape T1 on the work C which is to be hemmed, the sewing operation is carried out as follows: That is, the tape T1 is set on the bed 2 below the first guide member 10 with its edge abutted against the regulating surface 22 of the first guide member 10. Thereafter, the bottom hem stitching is carried out with the tape T1 also being fed towards the needle plate of the sewing machine. Thus, the tape is sewed on the work as shown in FIG. 6(B).

Furthermore, it may be required to attach the tape T1 to the bottom of the work C which is not to be hemmed. In this case, the sewing operation is carried out under the conditions that the bottom of the work C is not folded, and instead the edge of the latter C is abutted against the second regulating surface 39 of the second guide member 30.

In a tape stitching for sewing the rolled hem tape T2 to the bottom of the work C, similarly as in the above-described bottom hem stitching the position of the first guide member 10 is adjusted in the orthogonal horizontal direction until the first regulating surface 36 of the second guide member 30, against which the edge of the work C which is folded being inserted into the narrow space 65 in the third guide member 30 is abutted, is in alignment with the position of the left needle 1A in the sewing machine. Under this condition, the locking screw 13 is inserted into the elongated hole 12 of the first guide member and engaged with the auxiliary bed 3, to fixedly mount the first guide member 10 on the auxiliary bed 3.

Thereafter, the third guide member 50 is moved with respect to the first guide member 10 by turning the position adjusting screw 57 so that both edges of the rolled hem tape T2 inserted into the narrow space 65 in the third guide member 50 abut against the first regulating surface 36 or the second regulating surface 39 of the second guide member 30.

Figure 5:
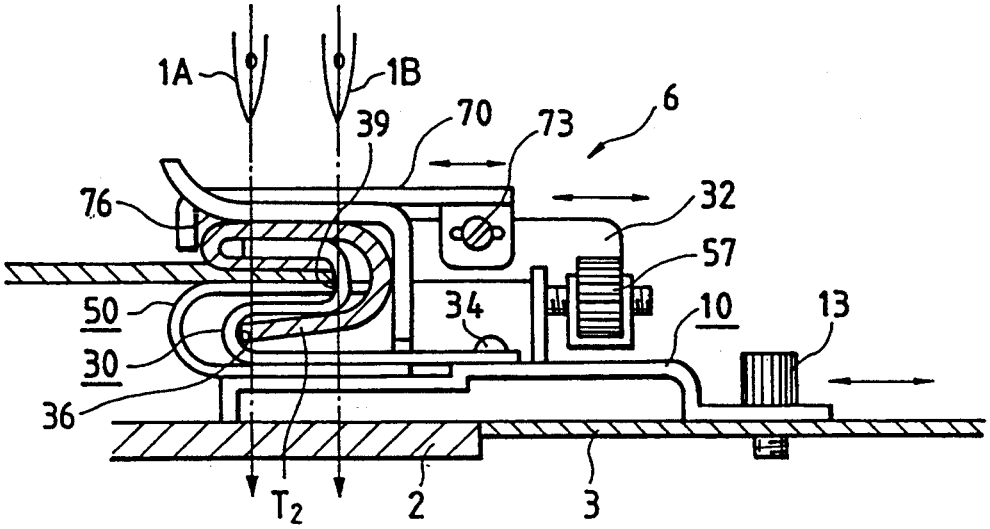
FIG. 5 is a front view, partially as a longitudinal sectional view, for a description of a rolled hem tape stitching with the guide device according to the invention.

Under this condition, as shown in FIG. 5, the rolled hem tape T2 is folded being inserted into the narrow gap 65 and extended along the second guide member 30, so that both edges of the rolled hem taped T2 abut against the first and second regulating surfaces 36 and 39 of the second guide member 30, respectively.

Figure 6C:
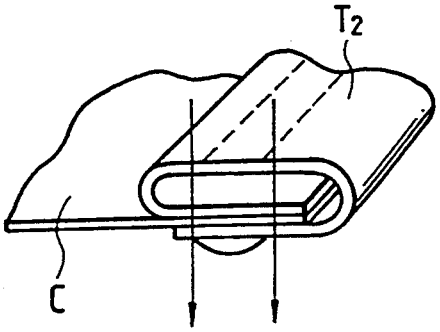
FIG. 6(C) is also a perspective view for a description of a rolled hem tape stitching.

Next, the fourth guide member 70 is moved in the orthogonal horizontal direction so that the pushing surface 76 of the fourth guide member 70 pushes the other fold of the rolled winding T2 against the edge 42 of the second guide member. Thereafter, the locking screw 73 is inserted into the elongated hole 72 of the fourth guide member 70 and engaged with the threaded hole 64 of the third guide member 50, so that the fourth guide member 70 is fixedly mounted on the third guide member 50. Under this condition, the sewing operation is carried out while, with the edge of the work C kept abutted against the second regulating surface 39 of the second guide member 30, the work C and the rolled hem tape T2 are being fed in such a manner that they are partially joined with each other. Thus, the rolled hem tape has been sewn on the bottom of the work as shown in FIG. 6(C).

As is apparent from the above description, with the guide device of the invention, both the bottom hem stitching and the tape stitching can be achieved. That is, even if hemming the fabric is switched over to another one, it is unnecessary to replace the guide device 6; that is, the operation of the sewing machine is simplified as much.

The guide device can be manufactured at low cost because it comprises only four guide members 10, 30, 50 and 70.

While there has been described in connection with the preferred embodiment of this invention, it will be obvious to those skilled in the art that various changes and modifications may be made therein without departing from the invention.

As is apparent from the above description, with the above-described guide device of the invention, not only the bottom hem stitching but also the tape stitching can be performed, which simplified the operation of the sewing machine as much. Furthermore, the guide device can be manufactured at low cost. Those effects should be highly appreciated.

What is claimed is:

1. A guide device for a sewing machine used for hemming a work, sewing a tape on the work and sewing a rolled hem tape on the work, said guide device comprising:

a first guide member having a regulating surface for regulating an edge of the tape, said first guide member being mounted on a bed of said sewing machine;

a second guide member having two regulating surfaces which regulate the position of one edge of the work or one edge of the rolled hem tape and the position of the other edge of the rolled hem tape, respectively, said second guide member being fixedly mounted on said first guide member;

a third guide member having a narrow space into which the work or a fold of the rolled hem tape is inserted, said third guide member being mounted on said first guide member; and a fourth guide member having a pushing surface for pushing another fold of the rolled hem tape against said second guide member, said fourth guide member being mounted on said third guide member.

2. A guide device according to claim 1, wherein said first guide member further has a first positioning portion for slidably positioning said first guide member in relation to said bed and a first locking member for fixedly mounting said first guide member on said bed, wherein said third guide member further has a second positioning portion for slidably positioning said third guide member in relation to said first member and a second locking member for fixedly mounting said third guide member on said first guide member, and wherein said fourth guide member further has a third positioning portion for slidably positioning said fourth guide member in relation to said third guide member and a third locking portion for fixedly mounting said fourth guide member on said third guide member.

3. A guide device for a sewing machine used for hemming a work, sewing a tape on the work and sewing a rolled hem tape on the work, said guide device comprising:

a first guide member mounted on a bed of said sewing machine, said first guide member having a horizontal portion spaced above said bed;

a second guide member fixedly mounted on said first guide member, said second guide member having, a first horizontal portion kept in contact with said first guide member in part, a second horizontal portion arranged above said first horizontal portion of said second guide member, and a third horizontal portion arranged above said second horizontal portion of said second guide member;

a third guide member mounted on said first guide member, said third guide member having, a first horizontal portion kept in contact with said first guide member in part and with said first horizontal portion of said second guide member, a third horizontal portion arranged above said third horizontal portion of said second guide member; and a fourth guide member mounted on said third guide member, said fourth guide member having, a horizontal portion arranged above said third horizontal portion of said third guide member, and a vertical portion passed through said third horizontal portion of said third guide member.

4. A guide device according to claim 3, wherein said first guide member further has a first positioning portion for slidably positioning said first guide member in relation to said bed and a first locking member for fixedly mounting said first guide member on said bed, wherein said third guide member further has a second positioning portion for slidably positioning said third guide member in relation to said first member and a second locking member for fixedly mounting said third guide member on said first guide member, and wherein said fourth guide member further has a third positioning portion for slidably positioning said fourth guide member with relation to said third guide member and a third locking portion for fixedly mounting said fourth guide member on said third guide member.

5. A sewing machine with a guide apparatus used for at least bottom hem stitching and tape stitching, said guide apparatus comprising:

a first guide member fixed to the top of a bed of said sewing machine and having a control surface defined to control the position of the tape edge;

a second guide member secured to said first guide member thereon and having two control surfaces, one control surface to control the position of the edge of said work or a rolled hem tape and the other control surface to control the position of the other edge of said rolled hem tape;

a third guide member rigidly mounted to said first guide member thereon and having a contracted portion hereof into which a gold of said work or said rolled hem tape is inserted; and a fourth guide member fixed to said third guide member and having an abutment surface for urging another fold of said rolled hem tape to said second guide member.

* * * * *